US007784933B2

(12) United States Patent
Noe et al.

(10) Patent No.: US 7,784,933 B2
(45) Date of Patent: Aug. 31, 2010

(54) SMART PROJECTOR GUIDES FOR HANDPRINTERS

(75) Inventors: Gary Lee Noe, Lexington, KY (US); William Henry Reed, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 1086 days.

(21) Appl. No.: 11/427,355

(22) Filed: Jun. 29, 2006

(65) Prior Publication Data

US 2008/0055384 A1 Mar. 6, 2008

(51) Int. Cl.
*B41J 3/36* (2006.01)
*B41J 3/00* (2006.01)
*B41J 29/13* (2006.01)

(52) U.S. Cl. ..... 347/109; 347/2; 347/108

(58) Field of Classification Search ..... 347/109, 347/2, 108; 346/143; 400/88
See application file for complete search history.

(56) References Cited

U.S. PATENT DOCUMENTS 5,012,349 A * 4/1991 de Fay ..... 358/296
5,063,451 A * 11/1991 Yanagisawa et al. ..... 346/143
5,446,559 A * 8/1995 Birk ..... 358/473
5,650,820 A * 7/1997 Sekine et al. ..... 347/263
5,986,769 A * 11/1999 Krzyminski ..... 356/445
6,116,707 A * 9/2000 Avida ..... 346/139 R
6,270,013 B1 * 8/2001 Lipman et al. ..... 235/454
6,292,274 B1 * 9/2001 Bohn ..... 358/473
6,315,423 B1 11/2001 Yu et al.
6,454,421 B2 9/2002 Yu et al.
6,678,081 B2 1/2004 Nishihata et al.
6,846,119 B2 * 1/2005 Walling ..... 400/88
6,854,821 B2 * 2/2005 Ericson et al. ..... 347/14
7,034,370 B2 4/2006 Kuo
7,042,613 B2 5/2006 Barnea et al.
7,046,421 B1 5/2006 Fu
2004/0027443 A1 * 2/2004 Trent ..... 347/109
2007/0139508 A1 * 6/2007 Muyskens ..... 347/109
2007/0140770 A1 * 6/2007 Writt ..... 400/88
2007/0147930 A1 * 6/2007 Nishath et al. ..... 400/88

OTHER PUBLICATIONS

Unknown, www.dlp.com, DLP Technology Overview, "Who Says You Can't Be Cutting-Edge and Tried and True?", Copyright 2006, Texas Instruments Incorporated, Dallas, TX, USA.

(Continued)

*Primary Examiner*—Stephen D Meier
*Assistant Examiner*—Leonard S Liang

(57) ABSTRACT

An improved handheld printer includes projectors to project images of the various page content that remains to be printed on the page. By providing this visual indication of locations of the page that remain to be printed, the projectors assist the user in achieving full coverage of the page when moving the handheld printer across the page. The projectors emit a narrow beam of light that can be rapidly scanned, with the assistance of micromirror-based optics, over points composing an area on the page to create a visual image to guide the user along the page. The projectors can be used to project an actual image of the page content to be printed. Alternatively, the projectors can project signals or other meaningful information onto the page that provide instructions to the user or point the user towards void areas that have been missed.

20 Claims, 7 Drawing Sheets

OTHER PUBLICATIONS

Unknown, www.answers.com, Digital Micromirror Device, Copyright 2006, Answers Corporation, USA.

Goldberg et al., "A MEMS Mirror for Optical Scanning", [Date unknown but prior ro Jun. 29, 2006], Applied MEMS, Inc., Stafford, Texas, USA.

Unknown, www.appliedmems.cc, MicroMirrors Product Family, Introduction/Product Approach, Copyright 2002, Applied MEMS, Inc., Stafford, Texas, USA.

Unknown, DuraScan Micro-Mirror Evaluation Kit, [Date unknown but prior ro Jun. 29, 2006].

Unknown, www.colibrys.com, Telecommunications/Micro-Mirrors, Copyright 2006, Colibrys, Neuchatel, Switzerland.

Unknown, www.memsoptical.com, MEMS Optical Products, Scanning Two Axis Tilt Mirrors, Copyright 2002, MEMS Optical Inc., Huntsville, AL, USA.

Unknown, www.colibrys.com, Optical MEMS for Telecom, [Date unknown but prior ro Jun. 29, 2006], Colibrys, Neuchatel, Switzerland.

Unknown, www.sme.org, A MEMS Mirror for Optical Scanning, Technical Paper Description/Product Order, Jan. 10, 2002, Society of Manufacturing Engineers, USA.

* cited by examiner

SMART PROJECTOR GUIDES FOR HANDPRINTERS

BACKGROUND OF THE INVENTION

This invention relates to handheld printing devices, and specifically to projector guides to assist in movement of a handheld printing device.

Handheld printers are a relatively recent development with a wide range of applicable uses. In particular, printing border effects across the edges of paper has been investigated as well as printing web pages from mobile (telephone) devices. To operate the printer, the user is typically required to manually move the printer across a substrate or sheet of paper. While the printer is in motion, and while it is in an active print mode (often achieved by pressing a button), the handheld printer will print. The printer can sense position on the paper and deposit ink on the page whenever the area under the print element matches an unprinted section of the page image to be printed. The printing can be accomplished using a print engine and print controller implemented in a manner known to persons skilled in the art.

When printing a page with a handheld printer, multiple passes across the paper are usually made to complete a document page. The operator will typically overlap these swaths of print so that no portion of the page is unprinted, leaving a void or print defect. Accordingly, there is a need for a device that assists the operator in locating areas where an image remains to be printed on the page so that adjacent swaths can be printed with minimal overlap and few print voids.

SUMMARY

The present invention provides an improved handheld printer including projectors to project images, which can provide a visual indication of locations on the page that remain to be printed, onto the print medium to assist the user in operating the handheld printer. Accordingly, it is a first aspect of the present invention to provide a printing device including: a housing; a print engine and print controller disposed in the housing and adapted to print an image on a print medium; and at least one projector disposed in the housing; where the at least one projector is adapted to project a visual display onto the print medium that provides information to a user. In detailed embodiments, the visual display can be image or a block representation of page content remaining to be printed at a portion of the area of the print medium. Alternatively, the visual display can be a reference with which a user can align the printing device. Alternatively, the visual display can include symbols that provide information to a user, such as setup parameters, printer configuration settings, or instructions to be followed by the user.

In an alternative detailed embodiment of the first aspect of the present invention, the printing device further includes: a light source; a moveable mirror disposed in the housing and pivotable around at least two perpendicular axes; at least one fixed mirror disposed in the housing; where the moveable mirror directs light from the light source to the fixed mirror; and where the fixed mirror directs light from the moveable mirror to a point on a print medium, the location of the point on the print medium being determined by the position of the moveable mirror on its two perpendicular axes of rotation. In a further detailed embodiment, the location of the point on the print medium is moved rapidly by rapidly rotating the moveable mirror to a series of new positions on its at least two perpendicular axes of rotation, and the light source is illuminated each time the moveable mirror is in a position to cause light to be directed to a point composing a visual image on the print medium, whereby a visual image is produced on the print medium. The moveable mirror can be rotated about its at least two perpendicular axes of rotation by a piezoelectric or galvanometric actuator. A sequence of commands that control the illumination of the light source can be received by the printing device or can be generated by a central processing unit located in the printing device. The light source can be a light emitting diode, which can include an optical cap to direct the light into a substantially collimated beam, or the light source can be a laser.

In an alternative detailed embodiment of the first aspect of the present invention, the printing device further includes: a light source; optics configured to direct light emitted from the light source to a point on the print medium; and actuators controlled to rapidly move the location of the point on the print medium; whereby a visual image is produced on the print medium.

In an alternative detailed embodiment of the first aspect of the present invention, the printing device further includes: a light source; a means for directing light emitted from the light source to a point on the print medium; and a means for rapidly moving the location of the point on the print medium; whereby a visual image is produced on the print medium.

It is a second aspect of the present invention to provide a method of printing a page, including: (a) moving a printing device across a print medium by a user; (b) depositing ink on the print medium by the printing device when the printing device is positioned over a location on the print medium where a portion of a page content is to be printed; and (c) projecting a visual display, by the printing device, onto a portion of the print medium where a portion of the page content remains to be printed. The method can further include (d) in response to viewing the visual display projected in step (c), moving the printing device, by the user, over a location on the print medium onto which the visual image is projected. The method can further include (e) repeating steps (a) through (d) until the entire page content has been printed on the print medium. the moveable mirror is rotated about its at least two perpendicular axes of rotation by a piezoelectric actuator.

These and other aspects and embodiments will be apparent from the following description, the accompanying drawings, and the appended claims.

DETAILED DESCRIPTION

Figure 1:
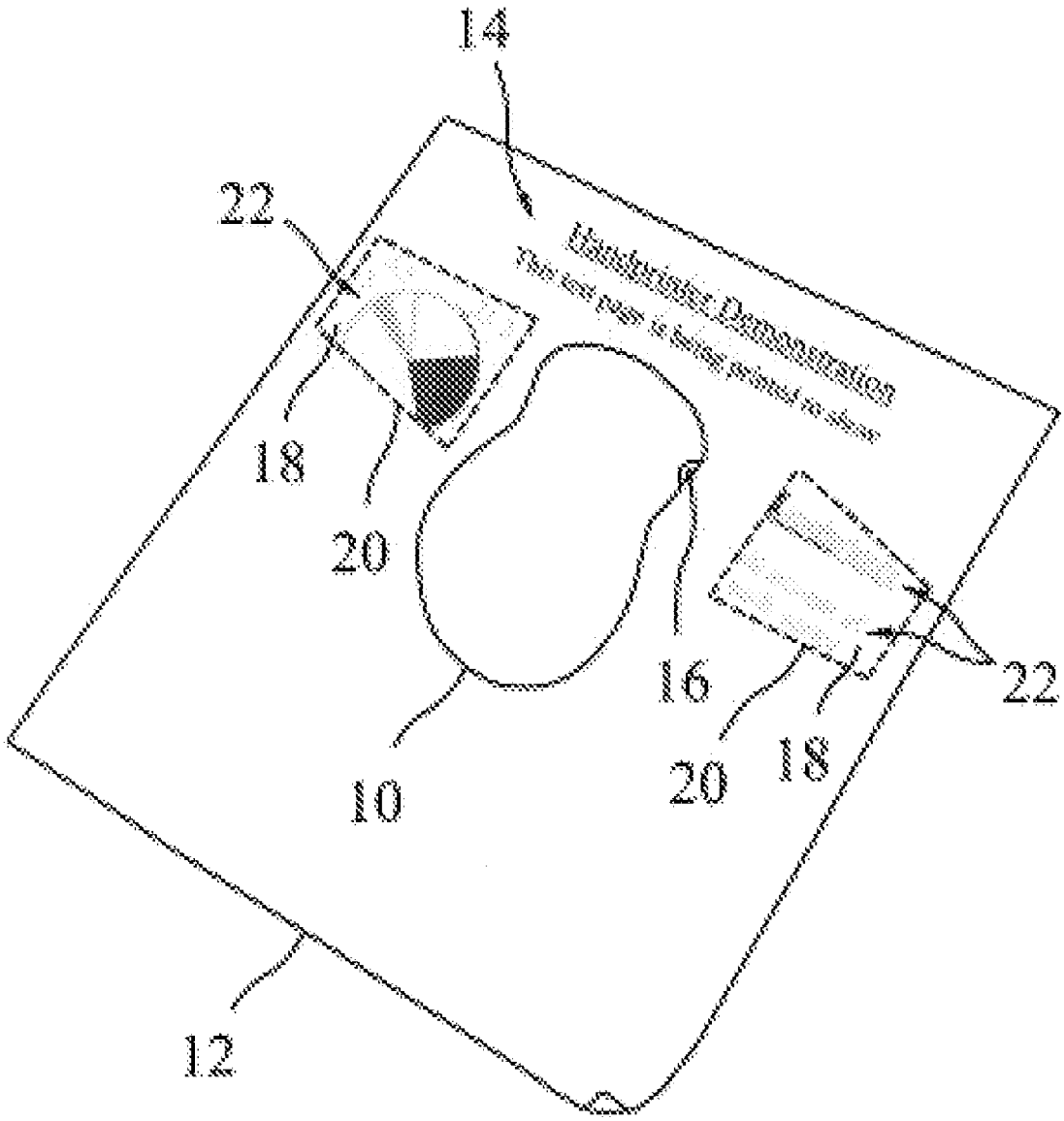
FIGS. 1 and 2 illustrate a handheld printer including projectors to illuminate areas on the page where content remains to be printed, according to an exemplary embodiment of the present invention.

As seen in FIG. 1, a handheld printer 10 can be moved over a substrate 12, which can be a piece of paper or other surface, by a user's hand in order to print the prescribed page image. In the example shown in FIG. 1, the text 14 near the top of the page has already been printed on the page, and the handheld printer 10 is ready to be moved to the remaining areas on the page where the visual material is to be printed. In order to print the entire content for the page, the handheld printer is moved over each location on the page where visual material is to be printed. The present invention provides a projector guide for the handheld printer that assists the user in locating the areas on the page over which the handheld printer should pass in order to print the complete page content.

With continued reference to FIG. 1, the handheld printer is equipped with one or more projectors 16 that can illuminate areas on the page where visual page content remains to be printed. As described more fully below, each projector 16 emits a narrow beam of light that can be rapidly scanned, with the assistance of micromirror-based optics, over an area on the page to create a visual image to guide the user along the page. In an exemplary embodiment, each projector 16 is capable of projecting a visual image onto a generally trapezoidal-shaped area 18 of the page bounded by the perimeter 20 as depicted in FIG. 1. Depending on the shape and configuration of the optics used, the area 18 into which the visual image can be projected can be rectangular or have other shapes, as discussed below.

Figure 2:
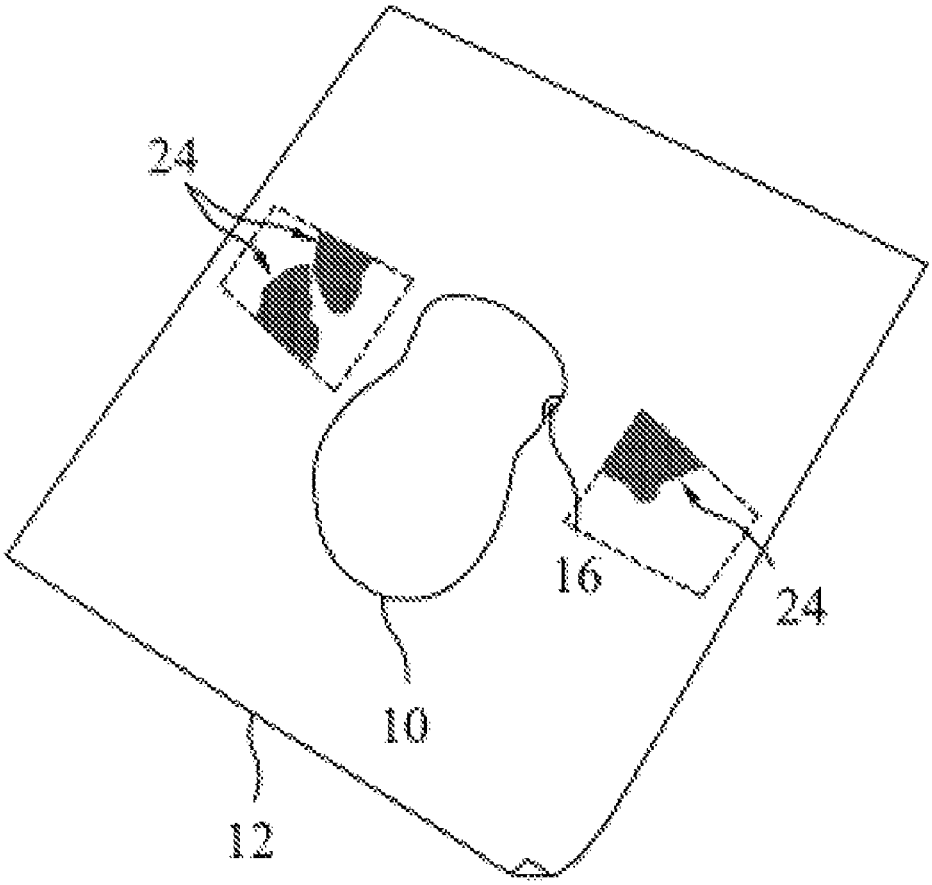

In the embodiment shown in FIG. 1, the projectors project images 22 of the various content elements (such as text and graphics) that remain to be printed on the page. Upon seeing these images, the user will know that the handheld printer should be moved over each of those areas of the page. FIG. 2 shows an alternative embodiment in which the areas remaining to be printed are illuminated as relatively low resolution blocks 24 rather than the relatively sharp images 22 shown in FIG. 1. The use of the relatively low resolution blocks 24 seen in FIG. 2 demands less precision from the projectors 16 and the mechanism described below, but still provides the user with a visual indication of the areas on the page where content remains to be printed.

In the embodiments shown in FIGS. 1 and 2, two projectors 16 are shown on the handheld printer 10, located on opposite sides of the printer. This arrangement allows the projectors to indicate content remaining to be printed on the page along an axis parallel to the direction in which the user is moving the handheld printer across the page. With the aid of projectors in this arrangement, the user can move the handheld printer in several approximately parallel passes or swaths across the page, taking care to move the handheld printer over each point that is illuminated by the projectors in order to print that portion of the page image. Upon finishing a swath or band of the page, the user can move the handheld printer slightly down the page to a new swath or band adjacent and generally parallel to the previous one. The user can then repeat the process of moving the handheld printer in several approximately parallel passes or swaths across the page in this new band, taking care to move the handheld printer over each point that is illuminated by the projectors in order to print that portion of the page image. In this manner, the two projectors 16 arranged along an axis can assist the user in printing the entire page image. Other arrangements and numbers of projectors can also be used and are within the scope of the invention.

Figure 3:
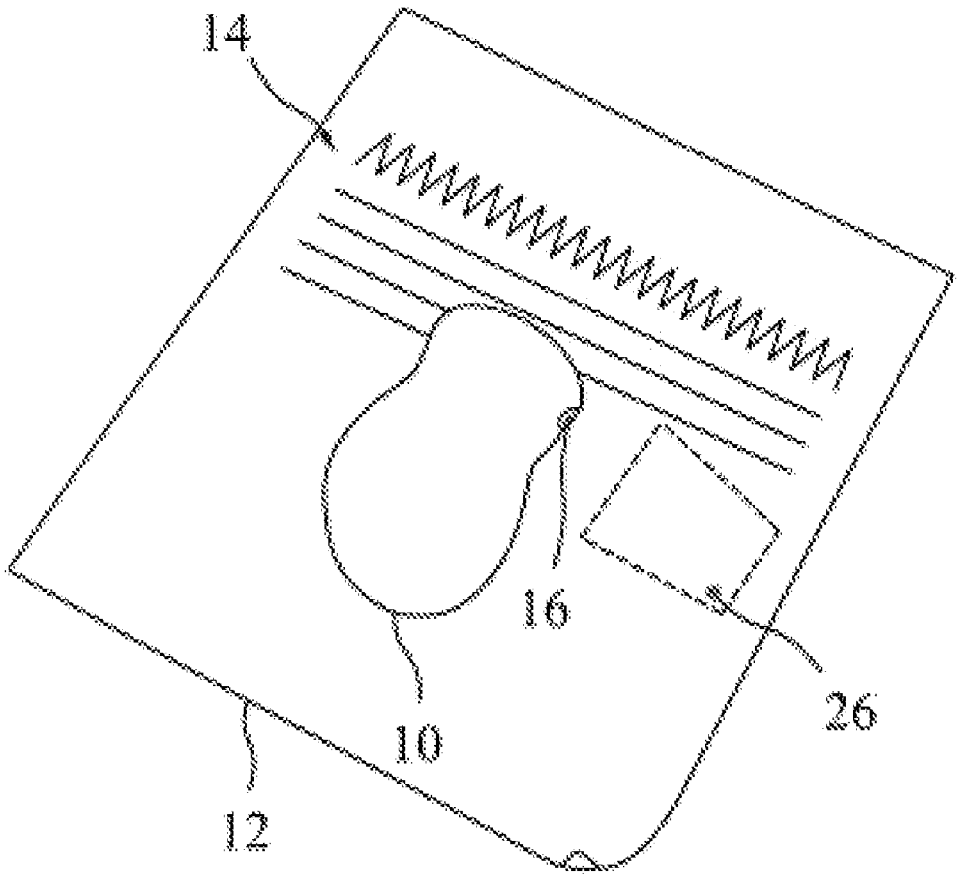
FIG. 3 illustrates a handheld printer including projectors to illuminate a small spot on the page to provide a reference point for the user's movement of the handheld printer, according to an exemplary embodiment of the present invention.

In another embodiment depicted in FIG. 3, the projector 16 on the handheld printer 10 can project a small illuminated spot 26 onto the page as a reference point. This reference point can be used as an indication for the user to move the handheld printer to that location to resume printing the page content. This location-spotting mode of operation for the projectors can be employed in printing operations where the page content has been parsed into discrete blocks or objects for printing. Such parsing of the page content is described in U.S. patent application Ser. No. 11/278,976, filed Apr. 7, 2006, the disclosure of which is incorporated herein by reference. Additionally, the projector of the present invention can be employed to project signals or other meaningful information onto the page (for example, a blinking arrow) that alert the operator and point to a reference point. This can provide a means for the operator to reacquire position with a reference marker in the event the handheld printer loses navigation, as described in U.S. patent application Ser. No. 11/382,286, filed May 9, 2006, the disclosure of which is incorporated herein by reference.

Figure 4:
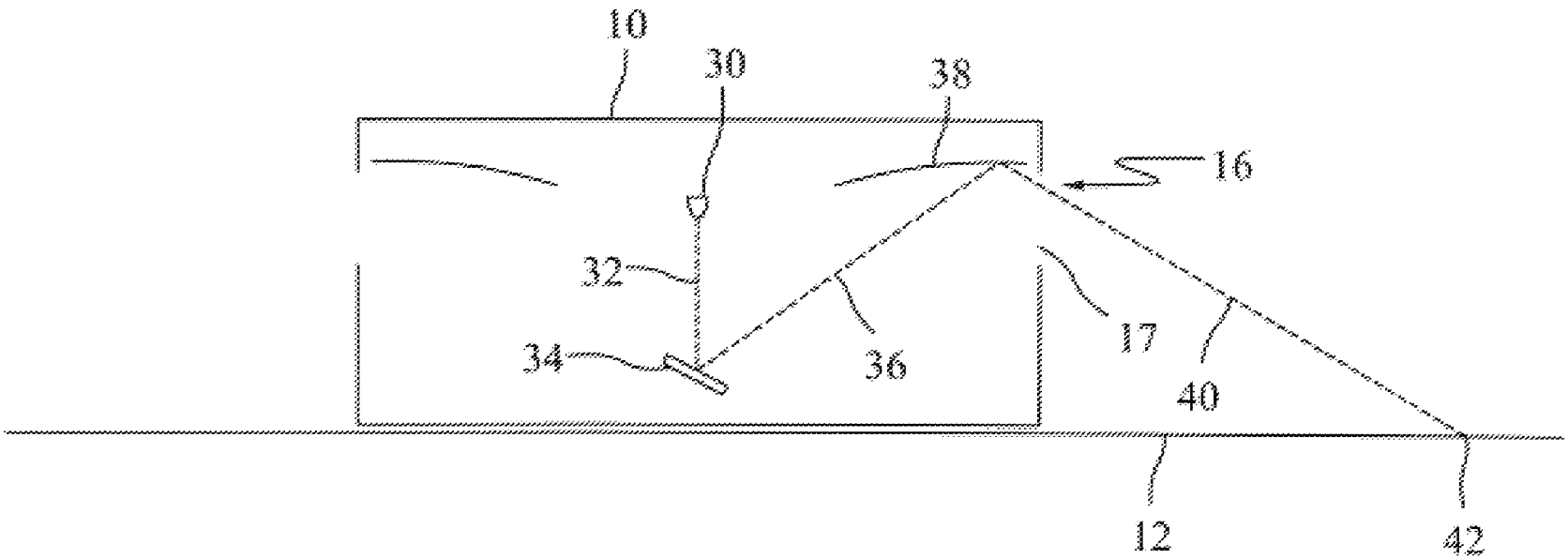
FIGS. 4 through 7 illustrate an optical arrangement for the projectors of a handheld printer, according to an exemplary embodiment of the present invention.
Figure 5:
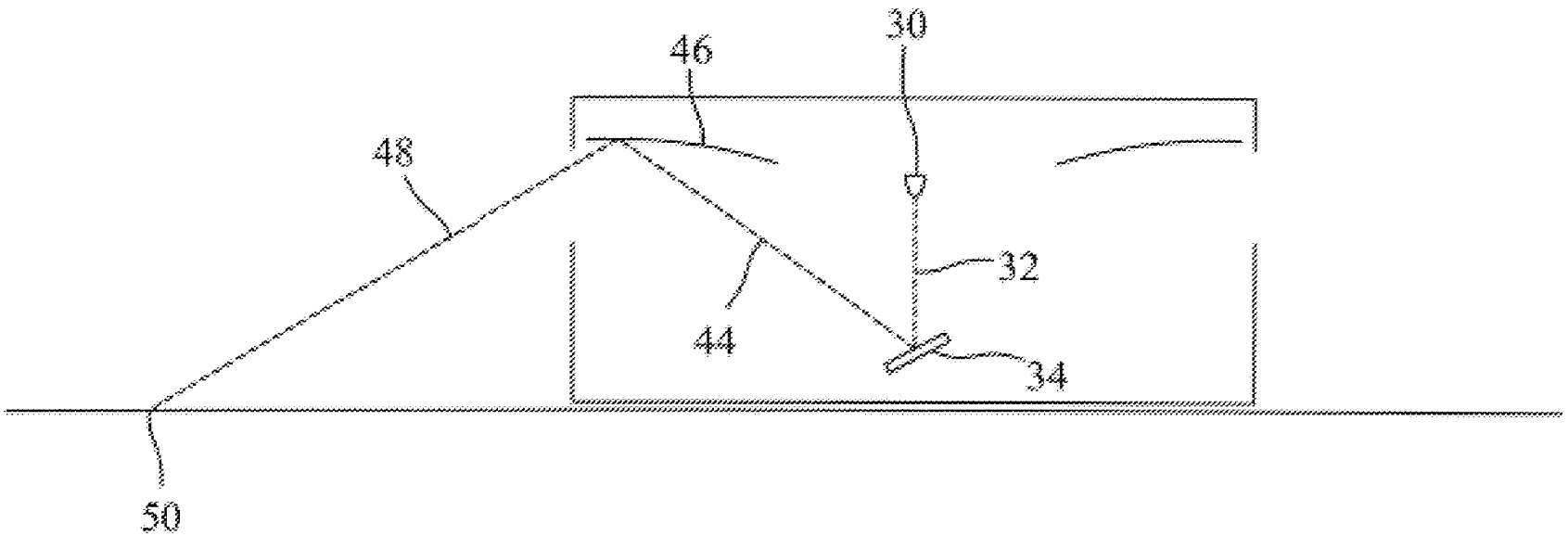
Figure 6:
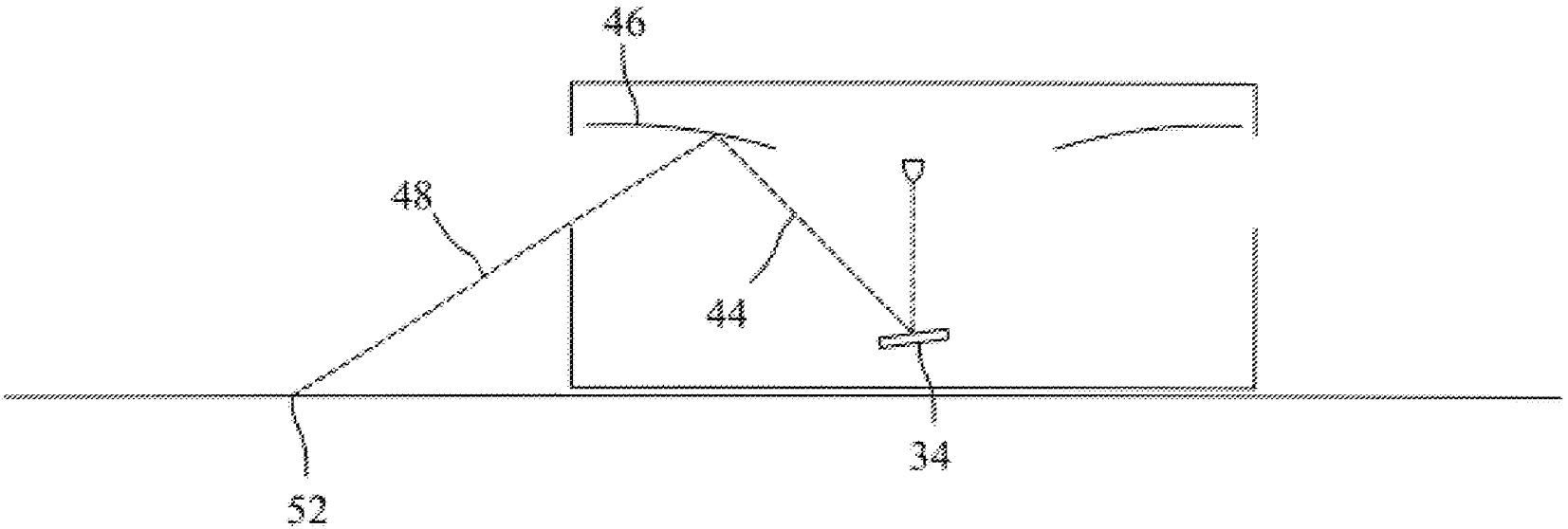

FIGS. 4 through 6 show schematic views of the optical arrangement and components of the projectors. As seen in FIG. 4, the handheld printer 10 is positioned on the page or substrate 12 and includes one or more projector apertures 17 through which a beam of light can be projected onto the page 12. Inside the handheld printer 10, a light source 30 is provided. In an exemplary embodiment, the light source 30 is a light-emitting diode fitted with a molded plastic lens that produces a relatively narrow and substantially collimated beam of light. Alternatively, other light sources can be used, and a converging lens can be placed approximate the light source to direct the light into a relatively narrow and substantially collimated beam.

The light beam from the light source 30 is depicted by the ray 32 in FIG. 4. The light beam 32 is directed onto a moveable mirror 34. In an exemplary embodiment, the moveable mirror 34 is a micromirror that is mounted to an actuator and pivotable along two axes. The actuator can be a piezoelectric or galvanometric element that enables the mirror's position to be continuously varied throughout a pre-determined range along each of the two axes. Such micromirrors and actuator assemblies are known to persons skilled in the art and are available from Colibrys AB, MEMS Optical, Inc., and other manufacturers. Such micromirrors and actuator assemblies are described in U.S. Pat. No. 6,454,421, which is incorporated herein by reference. The moveable mirror 34 reflects the beam (as represented by ray 36) to a fixed mirror 38, which reflects the beam (as represented by ray 40) through the aperture 17 and onto the page 12, where it becomes visible as an illuminated spot on the page at point 42. Alternatively, other optical mechanisms, such as a galvanometer scanner of the type used for laser scanning, can be used in place of the moveable mirror, as will be appreciated by persons skilled in the art. The fixed mirror 38 can be a flat mirror or a concave mirror. A flat mirror allows the light beam to reach points on the page falling within a generally trapezoidal area 18, as shown in FIGS. 1 through 3. A concave mirror allows the light beam to reach points on the page falling within a generally rectangular area.

FIG. 5 shows the moveable mirror 34 of the exemplary embodiment rotated so that the light beam 32 from the light source 30 is reflected to a second fixed mirror 46 on the opposite side of the handheld printer 10. This second fixed mirror 46 then reflects the beam onto the page 12 on that side of the handheld printer 10, where it becomes visible as an illuminated spot on the page at point 50. By rotating the moveable mirror 34 so that it alternately directs the light beam to the first fixed mirror 38 and the second fixed mirror 46, a single light source and moveable mirror can be employed to project illuminated spots from two projectors on different sides of the handheld printer. If the moveable mirror is moved between the two positions at a sufficient frequency, the human visual system will perceive both illuminated spots simultaneously on the page, as is known to persons skilled in the art. Thus, with two such fixed mirrors, a single moveable mirror assembly can display on either side of the printer or on two sides simultaneously. In one implementation, the light is projected onto the page only in the direction of printer motion, switching sides when a change in direction is sensed. In an alternate implementation, light can be displayed on both sides simultaneously, regardless of the direction in which the printer is moving.

FIG. 6 shows the moveable mirror 34 rotated to a different angle such that the light beam 44 strikes the fixed mirror 46 at a different angle than shown in FIG. 5, thereby causing the light beam 48 to be reflected from the fixed mirror 46 at a different angle than shown in FIG. 5. This causes the light beam 48 to intersect the page 12, and become visible as an illuminates spot, at a different point 52. As the moveable mirror 34 is rotated about its axes, the light source 30 can be strobed such that it emits a pulse of light each time the moveable mirror 34 is in a position to direct the light onto a point where illumination is desired. In this way, a visual image can be created on the page by selectively pulsing the light source as the moveable mirror 34 scans throughout its range of motion, thus directing a light beam to each point composing the image that is desired to be visible on the page. As discussed above, by moving the moveable mirror 34 at a sufficiently rapid rate, the illuminated spots projected onto the page at different positions will be simultaneously visible to the human eye. When this effect is achieved with multiple spots located in close proximity to one another on a common side of the handheld printer, as with the spots 50 and 52 shown in FIGS. 5 and 6, the illuminated spots can form a visual image on the page.

Figure 7:
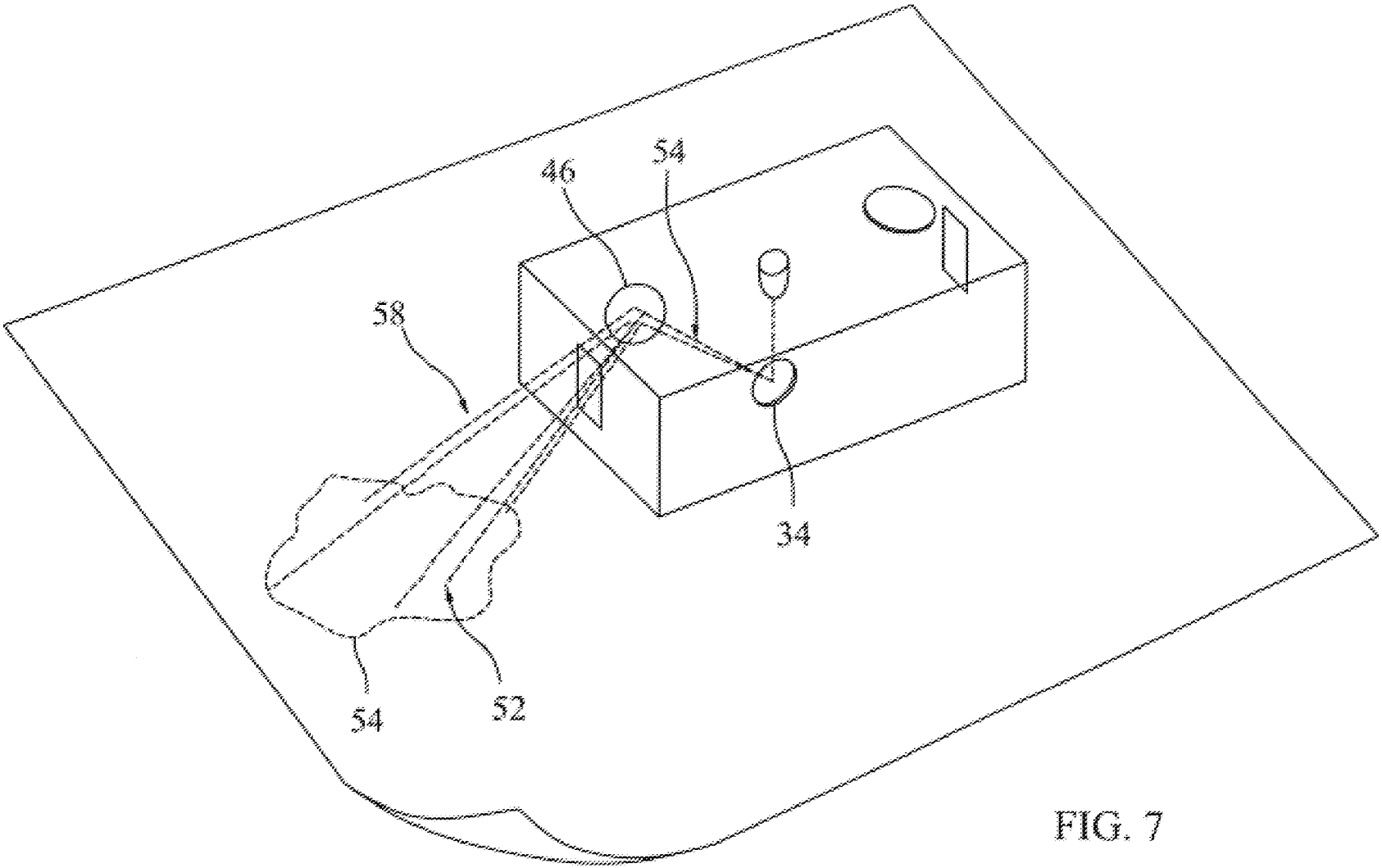

FIG. 7 is a three-dimensional perspective view illustrating the creation of a visual image 60 on the page. As mentioned above, the moveable mirror 34 can be rotated along two perpendicular axes of rotation, thus allowing the light to be reflected along one of a plurality of beam paths 54 to intersect the fixed mirror 46 at different points on its surface. The beam will thus be reflected by the fixed mirror 46 along a corresponding one of a plurality of beam paths 58 to illuminate a spot at a corresponding one of a plurality of points 52 on the page each time the light source is pulsed. The collection of points 52 constitutes the image 54 that is perceived by the human eye. By moving the moveable mirror 34 in a repetitive scan throughout its range of motion along its axes of rotation, the beam path can be made to reach each point on the page falling within the area 18 shown in FIGS. 1 through 3. This scanning by the micromirror can be controlled in a manner known to persons skilled in the art, such as is described in U.S. Pat. Nos. 7,046,421 and 7,034,370, which are incorporated herein by reference.

The use of the projector guides described herein to illuminate areas of the page where content remains to be printed provides several operational advantages. The end of a swath or band in the page content can be readily identified for the operator, thus eliminating the need for the operator to sweep the handheld printer over areas of the page looking for content where there is none. This, in turn, makes the operator less likely to overrun the edge of the paper and risk loss of navigation. Additionally, the projector can be used to project signals or other meaningful information onto the page (for example, a blinking arrow) that point the operator towards void areas that have been missed. This affirmative feedback can result in a significant improvement in print quality by allowing voids in the printed page image to be filled in as soon as possible before cumulative positional errors or ink drying prevent successful repair. Such efficiency can provide a particular advantage in the printing of color images and high-resolution images, where the sequence of drop colors and dry time effects are more noticeable in the print quality than in monochrome print or simple, relatively lower resolution printing.

In addition to document information and pointing to a next print location, the projectors of the present invention can display operational information such as setup parameters or printer configuration settings to the operator, thus enabling the operator to select or change functional settings for the printer. For example, by pressing buttons on the printer, the operator may select display language, paper size, or print quality setting from available choices displayed in the projected area. The use of the projectors of the present invention to display this information can eliminate the need to rely on a computer or other device to communicate such information to the user. This advantage enables the handheld printer to be used for printing from mobile information devices such as mobile phones and PDAs that might not provide the level of interactive support and user intervention that personal computers typically allow. Additionally, the projectors of the present invention can display instructions or prompts for the operator to follow. For example, the operator might be alerted of lower battery power or low ink level, or the projected display might point to unprinted areas that the operator has bypassed. By illuminating the paper, the use of projectors to display this information offers the benefit of operation in less well lighted areas. As can be seen, this invention enhances the standalone capability of a handheld printer without requiring cost a size burden of adding a display to the handheld printer.

For any of the embodiments described herein, the locations on the page to be illuminated by the projectors at any particular time (i.e. the visual image to be projected onto the page), and therefore the times at which the light source is illuminated, can be determined computationally by a computer or other device that provides the page content to be printed, or this location information can be determined computationally by a processing unit located in the handheld printer.

Having described the invention with reference to embodiments, it is to be understood that the invention is defined by the claims, and it is not intended that any limitations or elements describing the embodiments set forth herein are to be incorporated into the meanings of the claims unless such limitations or elements are explicitly listed in the claims. Likewise, it is to be understood that it is not necessary to meet any or all of the identified advantages or objects of the invention disclosed herein in order to fall within the scope of any claims, since the invention is defined by the claims and since inherent and/or unforeseen advantages of the present invention may exist even though they may not have been explicitly discussed herein.

What is claimed is:

1. A printing device, comprising:

a housing;

a print engine and print controller disposed in said housing and adapted to print an image on a print medium; and at least one projector disposed with said housing;

wherein said at least one projector is adapted to project a visual display onto the print medium that provides information to a user, the visual display being an image of page content remaining to be printed at a portion of an area of the print medium.

2. The printing device of claim 1, further including at least one additional projector with the housing to project light from a side of the housing opposite a side where the at least one projector projects light so the user is provided said information of the page content remaining to be printed on multiple said sides of the housing.

3. The printing device of claim 1, wherein said visual display is a block representation of variable resolution.

4. The printing device of claim 1, wherein said visual display includes a reference location.

5. The printing device of claim 4, wherein the reference location directs the user to a position to reacquire a lost navigation of the housing or to resume printing on the print medium.

6. The printing device of claim 1, wherein said visual display comprises symbols that provide operational information to the user.

7. The printing device of claim 6, wherein said operational information includes at least one of setup parameters and printer configuration settings.

8. The printing device of claim 7, wherein said operational information includes instructions to be followed by the user.

9. The printing device of claim 1, further comprising:

a light source;

optics configured to direct light emitted from said light source to a point on said print medium; and actuators controlled to rapidly move the location of said point on the print medium.

10. The printing device of claim 1, further comprising:

a light source;

a means for directing light emitted from said light source to a point on said print medium; and a means for rapidly moving the location of said point on the print medium;

whereby a visual image is produced on the print medium.

11. A printing device, comprising:

a housing;

a print engine and print controller disposed in said housing and adapted to print an image on a print medium; and at least one projector disposed with said housing adapted to project a visual display onto the print medium that provides information to a user, the at least one projector including, a light source;

a moveable mirror disposed in said housing and pivotable around at least two perpendicular axes;

at least one fixed mirror disposed in said housing;

wherein said moveable mirror directs light from said light source to said fixed mirror; and wherein said fixed mirror directs light from said moveable mirror to a point on the print medium.

12. The printing device of claim 11, wherein a location of said point on the print medium is moved rapidly by rapidly rotating the moveable mirror to a series of new positions about the at least two perpendicular axes of rotation; wherein the light source is illuminated each time the moveable mirror is in a position to cause light to be directed to the point.

13. The printing device of claim 11, wherein the moveable mirror is rotated about its at least two perpendicular axes of rotation by a piezoelectric actuator.

14. The printing device of claim 11, wherein the moveable mirror is rotated about its at least two perpendicular axes of rotation by a galvanometric actuator.

15. The printing device of claim 11, wherein a sequence of commands that control illumination of the light source is received by the printing device.

16. The printing device of claim 11, further comprising:

a central processing unit; wherein a sequence of commands that control illumination of the light source is issued by said central processing unit.

17. The printing device of claim 11, wherein said at least one fixed mirror is one of a flat mirror and a concave mirror.

18. A method of printing a page, comprising:

(a) moving a printing device across a print medium by a user;

(b) depositing ink on the print medium by the printing device when the printing device is positioned over a location on the print medium where a portion of a page content is to be printed; and (c) by the printing device, projecting a visual display onto another portion of the print medium, the visual display being a lighted image representative of page content that remains to be printed at the another portion of the print medium.

19. The method of claim 18, further comprising:

(d) in response to viewing the visual display projected in step (c), moving the printing device, by the user, over the another portion.

20. The method of claim 19, further comprising:

(e) repeating steps (a) through (d) until an entirety of the page content has been printed on the print medium.

* * * * *